US008006740B2

(12) United States Patent
Strom

(10) Patent No.: US 8,006,740 B2
(45) Date of Patent: Aug. 30, 2011

(54) HIGH PERFORMANCE BRAKE ROTOR

(75) Inventor: Peter Strom, Big Rapids, MI (US)

(73) Assignee: Synergen, Inc, Groose Pointe Woods, MI (US)

( * ) Notice: Subject to any disclaimer, the term of this patent is extended or adjusted under 35 U.S.C. 154(b) by 283 days.

(21) Appl. No.: 12/247,703

(22) Filed: Oct. 8, 2008

(65) Prior Publication Data

US 2010/0084110 A1 Apr. 8, 2010

(51) Int. Cl.

| | |
|---|---|
| ***B22D 19/00*** | (2006.01) |
| ***B22D 19/04*** | (2006.01) |
| ***B22D 19/16*** | (2006.01) |
| ***B22D 27/02*** | (2006.01) |

(52) U.S. Cl. ..... 164/98; 164/100; 164/108; 164/111; 164/112; 164/498

(58) Field of Classification Search ..... 164/98, 164/100, 108, 111, 112, 498
See application file for complete search history.

(56) References Cited

U.S. PATENT DOCUMENTS

| | | | | |
|---|---|---|---|---|
| 4,023,613 | A * | 5/1977 | Uebayasi et al. | 164/100 |
| 4,559,685 | A * | 12/1985 | Hara et al. | 29/888.047 |
| 5,620,042 | A * | 4/1997 | Ihm | 164/95 |
| 5,862,892 | A * | 1/1999 | Conley | 188/218 XL |
| 5,894,053 | A * | 4/1999 | Fried | 428/548 |
| 7,066,235 | B2 * | 6/2006 | Huang | 164/98 |

* cited by examiner

*Primary Examiner* — Kevin P Kerns
(74) *Attorney, Agent, or Firm* — Bill C. Panagos; Rader, Fishman & Grauer PLLC

(57) ABSTRACT

A method of forming a brake rotor includes forming a plurality of metal insert portions. Each insert portion includes an inner side and an outer side with a plurality of attachment members coupled to the inner side. The method also includes positioning the plurality of insert portions into a mold such that the inner side of one of the plurality of insert portions faces the inner side of another one of the insert portions. The method also includes introducing a molten aluminum into the mold such that the molten aluminum contacts the inner side of each insert portion. The method further includes forming a mechanical bond between the aluminum and at least a portion of at least one of the inserts.

11 Claims, 9 Drawing Sheets

HIGH PERFORMANCE BRAKE ROTOR

TECHNICAL FIELD

The disclosure generally relates to composite brake rotors and methods of manufacture.

BACKGROUND

Soaring fuel costs, global warming and other economic factors have made vehicle weight reduction a priority in the automotive industry in an effort to maintain customer satisfaction. These demands need to be made without compromising vehicle safety, necessitating finding a proper balance to satisfy all requirements. Grey iron steel has long been traditionally used in the manufacture of automotive brake rotors. While this application material has an expected performance satisfactory to industry standards, it offers limited opportunities for optimizing weight reduction and improved performance. Other attempts have been made to produce a brake rotor using lighter weight materials, accomplishing weight reduction goals only at the expense of cost and performance. This invention describes a disc brake rotor for a motor vehicle, made using conventional aluminum and steel materials and unique methods resulting in a light weight product with improved performance advantages over prior art.

It is known that rotors cast entirely from an aluminum alloy material possess strength deficiencies as temperatures elevate during normal braking use. Relatively thin wear inserts made of a suitably hard material such as steel encapsulated within the aluminum at the friction surfaces in contact with typical brake pads are capable of maintaining required strength under these conditions. Aluminum has known thermal conductivity properties superior to that of grey iron steel traditionally used in the manufacture of brake rotors, providing performance improvements from expected operation as friction heat is rapidly transferred from the steel inserts into the aluminum and then dissipated to air.

U.S. Pat. No. 5,620,042 by Ihm discloses a composite brake rotor, with friction surfaces made from metal matrix composite (MMC), an aluminum based material that includes silicon carbide particulate for reinforcement, and the rotor body made from conventional aluminum alloy.

U.S. Pat. No. 5,862,892 by Conley discloses a brake rotor made from aluminum combined with cast iron wear surfaces.

These disclosed rotor designs may have inherent problems. Metal matrix composite materials are expensive and very difficult to machine, making them cost prohibitive. In addition, special organic brake pads are required to be used for compatibility with the MMC material to prevent galling damage to the rotor surfaces. These pads are also more expensive when compared to conventional pads used with cast iron rotors, due to their material makeup and availability. And because they are made up mostly of aluminum, they have lower overall operating temperature potential. Smearing of the aluminum is also known to occur as the brake friction force exceeds the shear strength of the MMC material. Coefficient of thermal expansion differences can cause detrimental warping and separation problems on composite rotors made from both aluminum and cast iron or steel. The rotor disclosed by Conley uses cast iron wear surfaces that are interconnected to one another, limiting heat dissipation.

The present invention details the use of materials and methods to address these concerns. Material and labor cost concerns are managed by means of the use of commercially available grades of aluminum and steel. These materials have properties that promote ease of machining by cost effective conventional methods. This invention allows the use of common, commercially available mating brake pad components. The invention also describes a practical approach to solving warp and separation that may develop between the dissimilar materials. Slots are spaced radially around the steel wear inserts to allow adequate expansion to occur as temperatures elevate during normal brake use.

A suitable method of attaching the wear inserts to the aluminum rotor body is also described. Prior art methods for joining one metal to a second metal have been disclosed.

U.S. Pat. No. 4,023,613 by Uebayasi, et al. discloses a method for making composite metal castings by forming a plurality of teeth in at least one of the opposed surfaces of the metals being joined.

U.S. Pat. No. 5,894,053 by Fried, et al. discloses a process for applying a metallic adhesion layer for ceramic thermal barrier coatings to metallic components.

U.S. Pat. No. 7,066,235 by Huang discloses a method for manufacturing clad components that could be used for making an automotive brake rotor.

Inherent problems confronting the disclosed methods include cost to produce and accuracy. Processes for adding or attaching interlocking members add cost and must be tightly controlled to ensure robustness and repeatability from part to part in order to produce a rotor that meets rotating mass balancing requirements. In addition, hard spots can develop where the interlocking members join with the steel clad wear surface part due to process variables during heat treatment. The resulting hardness variations in the steel clad wear surfaces negatively affect brake wear performance.

The present invention describes alternative methods and design approaches that includes reliably and accurately adding interlocking members to one of the metals, and alternatively making one of the metals as a unitary part that includes the interlocking members

BRIEF DESCRIPTION OF THE DRAWINGS

Referring now to the drawings, illustrative embodiments are shown in detail. Although the drawings represent some embodiments, the drawings are not necessarily to scale and certain features may be exaggerated, removed, or partially sectioned to better illustrate and explain the present invention. Further, the embodiments set forth herein are exemplary and are not intended to be exhaustive or otherwise limit or restrict the claims to the precise forms and configurations shown in the drawings and disclosed in the following detailed description.

DETAILED DESCRIPTION

Figure 1:
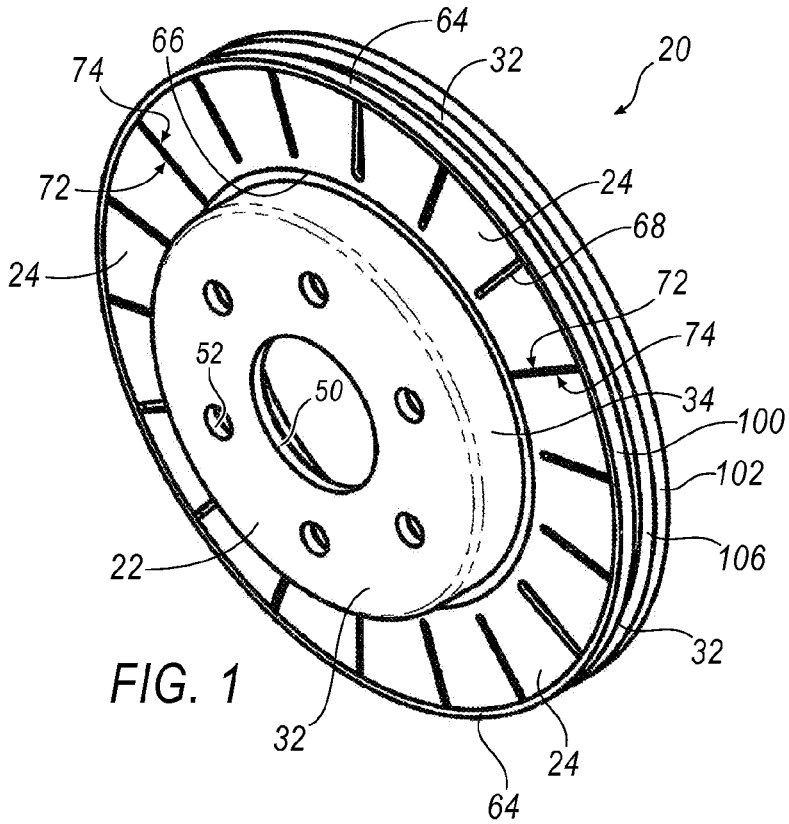
FIG. 1 is a perspective view of a composite rotor, according to an embodiment.

Although the drawings represent some embodiments, the drawings are not necessarily to scale and certain features may be exaggerated, removed, or partially sectioned to better illustrate and explain the present invention. Further, the embodiments set forth herein are exemplary and are not intended to be exhaustive or otherwise limit or restrict the claims to the precise forms and configurations shown in the drawings and disclosed in the following detailed description.

Figure 2:
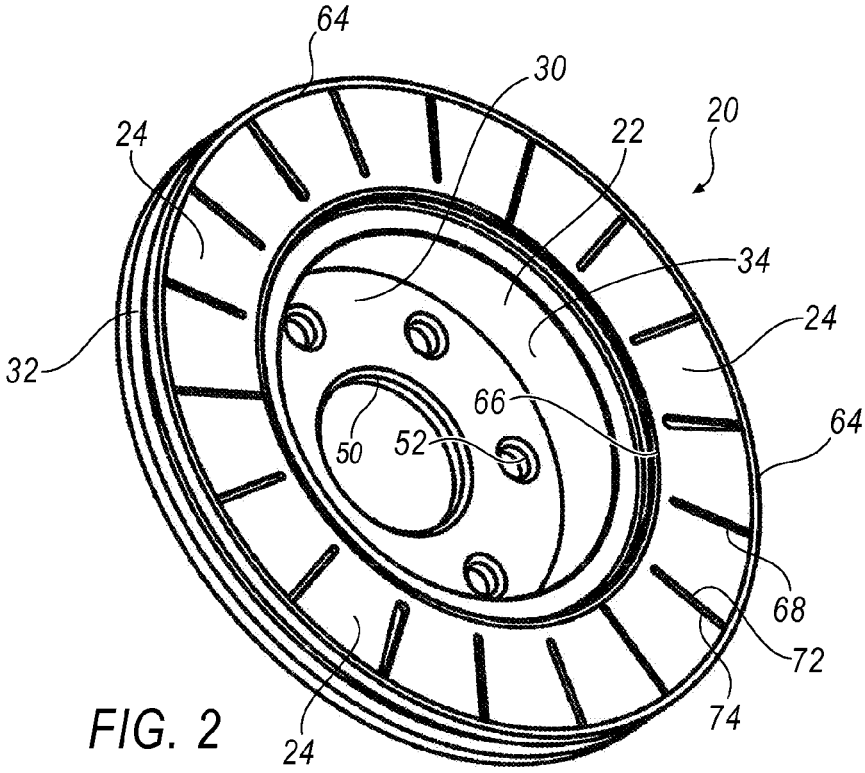
FIG. 2 is a perspective view of the rotor of FIG. 1, taken from a different view.
Figure 3:
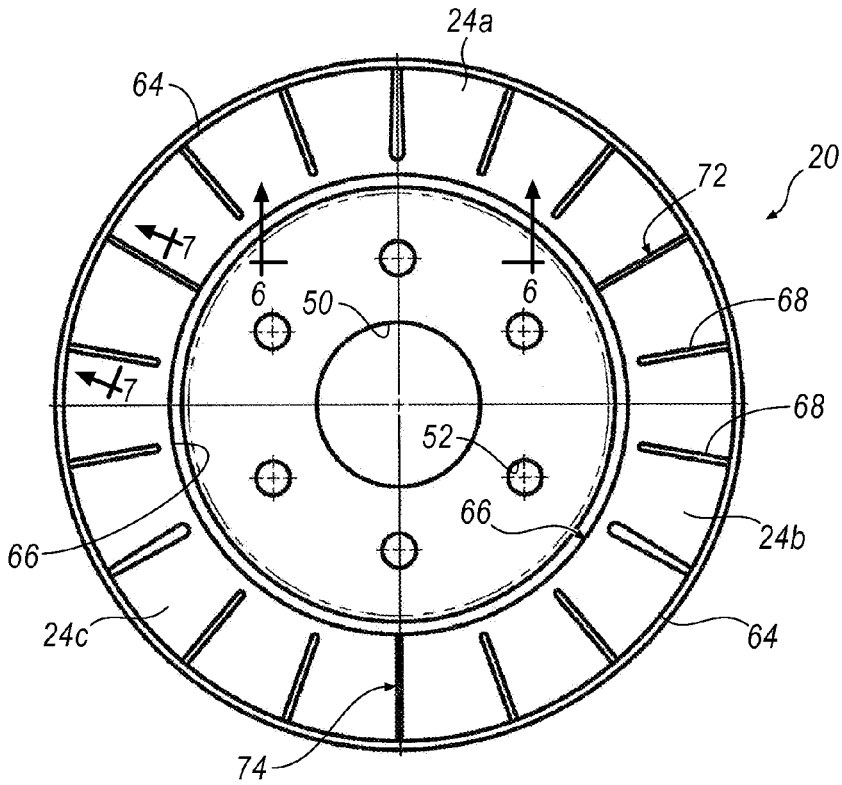
FIG. 3 is a side view of the composite rotor of FIG. 1

FIGS. 1-7 illustrate a composite brake rotor 20. FIGS. 1, 2 and 3 depict the rotor 20 to include a central body 22, and a plurality of inserts 24. The central body 22 includes an inner hub portion 30, an outer annular rotor portion 32, and a generally cylindrical interconnecting portion 34. The inner hub portion 30 is illustrated in the exemplary embodiment to include a central opening 50 and a plurality of lug connecting apertures 52. In the embodiment illustrated, the central body 22 is constructed of a single core material 106, although more than one material may be used.

Figure 4:
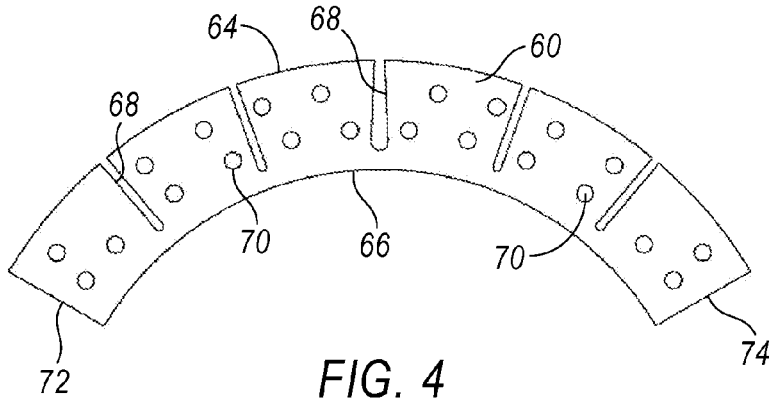
FIG. 4 is a side view of an insert portion of the rotor of FIG. 1.
Figure 5:
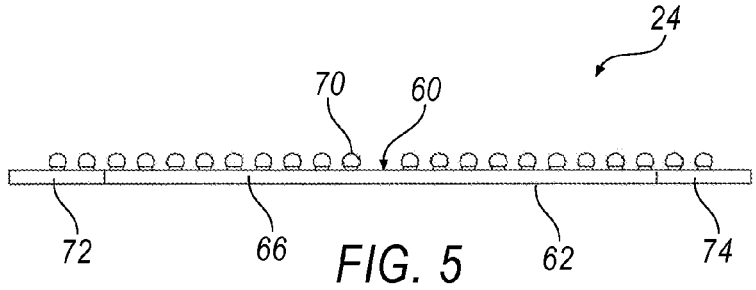
FIG. 5 is a view taken generally along line 5-5 of FIG. 4.
Figure 6:
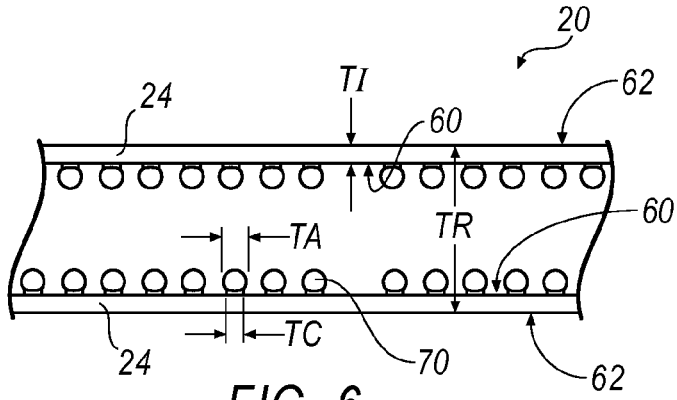
FIG. 6 is a partial sectional view taken generally along line 6-6 of FIG. 3, illustrating the composite rotor of FIG. 1 with an inner portion removed for clarity.
Figure 7:
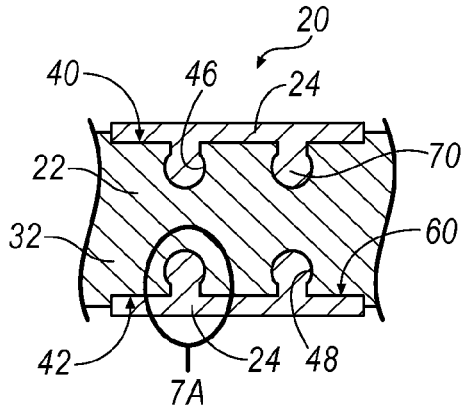
FIG. 7 is a partial sectional view taken generally along line 7-7 of FIG. 3.

FIGS. 4 and 5 illustrate one insert 24 to include an inner surface 60, an outer surface 62, an outer radial side 64, an inner radial side 66, a plurality of slots 68, a plurality of attachment portions 70, a first circumferential end 72, and a second circumferential end 74. Each insert is generally defined by a generally arcuate shape of about 120° and a thickness TI between the inner surface 60 and the outer surface 62. Each attachment portion 70 includes a body 80 and a collar 82, best shown in FIG. 7A. Each body 80 is attached to the inner surface 60 by one of the collars 82. As best seen in FIG. 6, each body 80 is defined by a dimension TA measured generally parallel to the inner surface 60, and each collar 82 is defined by a dimension TC measured generally parallel to the inner surface 60. The dimension TA is greater than the dimension TC to obtain a mechanical lock between the insert 24 and the body 22, as discussed in greater detail below. FIG. 7 shows the outer annular rotor portion 32, made up of core material 106 and fixed between a set of opposing inserts 24, creating a first contacting surface 40 and a second contacting surface 42. The first surface 40 is defined, at least in part, by a plurality of cavities 46 which are formed by core material 106 around each body 80 and collar 82, and the second surface 42 is defined, at least in part, by a plurality of cavities 48, which are also formed by core material 106 around each body 80 and collar 82.

Figure 7A:
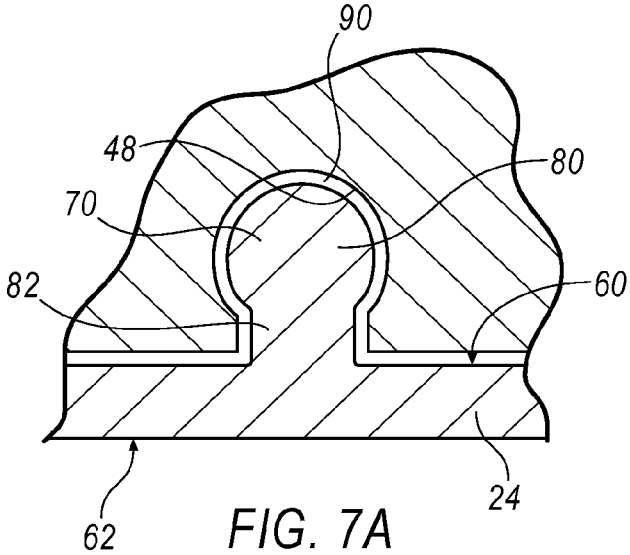
FIG. 7A is an enlarged view of portion 7A of FIG. 7.

As best seen in FIG. 7A, a coating 90 may be applied to the body 80, the inner surface 60, or the collars 82, or any combination thereof, as discussed in greater detail below. In FIG. 7A, the coating 90 thickness may be exaggerated and the coating 90 is not illustrated with section graphics for clarity.

In the embodiment illustrated, three generally arc shaped inserts 24 that may be of equal size are also equally arranged in a generally circular pattern to create a first brake pad wear surface 100 and a second brake pad wear surface 102 (FIGS. 1-2) on the outer annular rotor portion 32. In the exemplary embodiment illustrated, the material for inserts 24 is a low carbon steel, such as hot rolled ASTM A36. Low carbon steel has a relatively high coefficient of friction, which may be desirable for use in a brake rotor application. Other steel alloys could also be used, as desired. The inserts 24 may be of sufficient thickness to provide adequate finish machining, usage wear and maintenance machining over the expected life of the product, such required thickness being well known in the practical application of brake rotors. An exemplary thickness TI is 5.0 millimeters (mm) (0.200 inches). The casting material for core material 106 (of the central body 22) is aluminum alloy A356.2 in an exemplary embodiment. This material exhibits excellent casting, mechanical, machinability and corrosion resistance characteristics for a brake rotor application. Other aluminum casting alloys, or other materials, could also be used effectively.

Each insert 24 includes the multiplicity of attachment portions 70 to provide secure attachment to the core material 106 of body 22 as shown in FIG. 7. One purpose for each attachment portion 70 is to achieve retention by interaction with core material 106. Many means for incorporating each attachment portions 70 onto each insert 24 has also been disclosed. Attachment can be achieved by welding, brazing, the use of an organic binder, or any other well known method for fusing two metals together. Considering the importance of producing a well balanced rotor, an exemplary embodiment attaches each attachment portions 70 to each insert 24 by means of welding. A number of different welding methods could be used to attach attachment portions 70 to the inserts 24, including practical common methods such as spot welding or spin welding.

Figure 8:
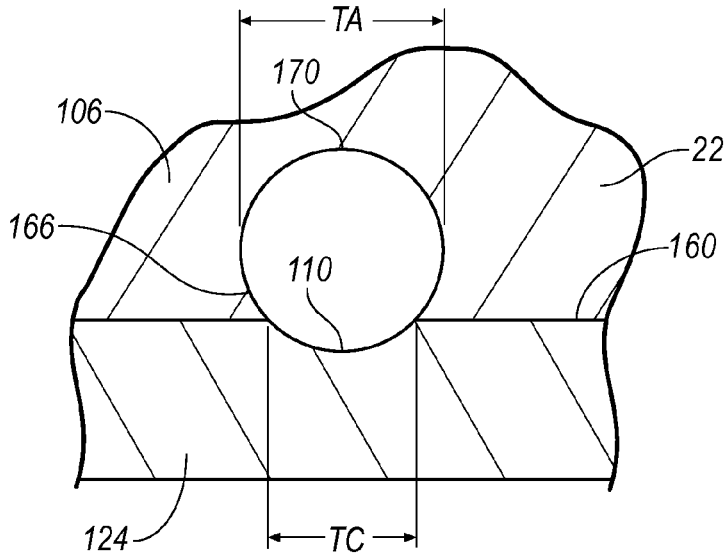
FIG. 8 is an alternative embodiment of the enlarged view of FIG. 7.

In an alternative embodiment depicted in FIG. 8, inserts 124 are formed generally the same as inserts 24 with the exception that no attachment portions 70 are included. The insert 124 may be formed with generally concave depression features 110 formed therein at locations on an inner surface 160 where attachment locations are desired. A generally spherical attachment portion 170 may be coupled each concave depression feature 110, generally matching the diameter of the sphere. The concave depression features 110 may provide additional welding surface area for coupling the attachment portions 170 to the inner surface 160. As shown in FIG. 8, an attachment portion 170 is defined by a dimension TA measured generally parallel to the inner surface 160, and a depression feature 110 is generally defined by a dimension TC, measured generally parallel to the inner surface 160. Each concave depression feature 110 would be shallow enough to maintain an undercutting surface portion 166 on each attachment portion 170 for accomplishing retention of the core material 106 of the central body 22. This is, the demension TA is greater than the dimension TC to mechanically retain the insert 124 to the core material 106 of the central body 22.

Referring back to FIG. 3, each insert 24 may include a multiplicity of slots 68 which allows movement of the segment arc caused by the different coefficient of expansion properties of the core material 106. As heating and cooling naturally occur during brake rotor use, slot 68 reduces distortion of each insert 24 as it is allowed to flex circumferentially while confined within the core material 106. Brake rotor endurance testing has revealed that the incorporation of the slots 68 as generally illustrated also eliminates the need and subsequent cost for thermal treatment processes of the core material 106.

Figure 9:
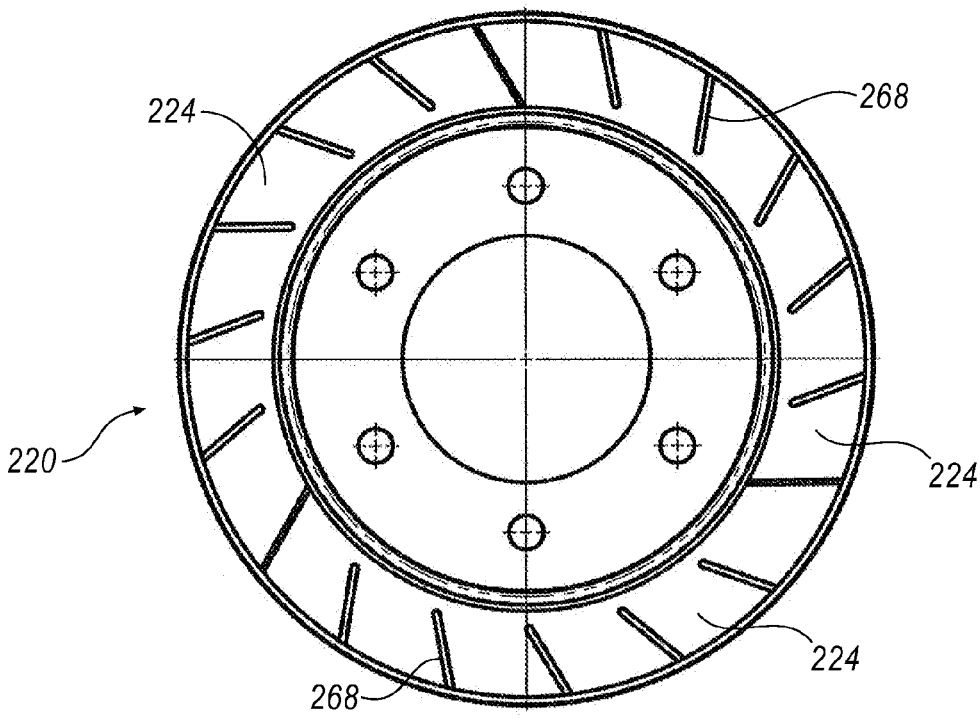
FIG. 9 is a side view of an alternative embodiment of the composite rotor of FIG. 1.

An alternate configuration of the slots 68 of the rotor 20 is shown in a rotor 220 of FIG. 9 where a slant is added with the intention of reducing wear between each insert 224 and a vehicle's brake pads. That is, a plurality of slots 268 do not extend radially from the axis of the rotor 220, but extend generally tangentially relative to a radius of the rotor 220. Each slanted slot 268 provides a shearing interaction between each insert 224 and contacting brake pads in the direction of rotation. Slots, such as slots 68 and 268, could also be arc shaped to provide a generally spiral shearing interaction.

Figure 11:
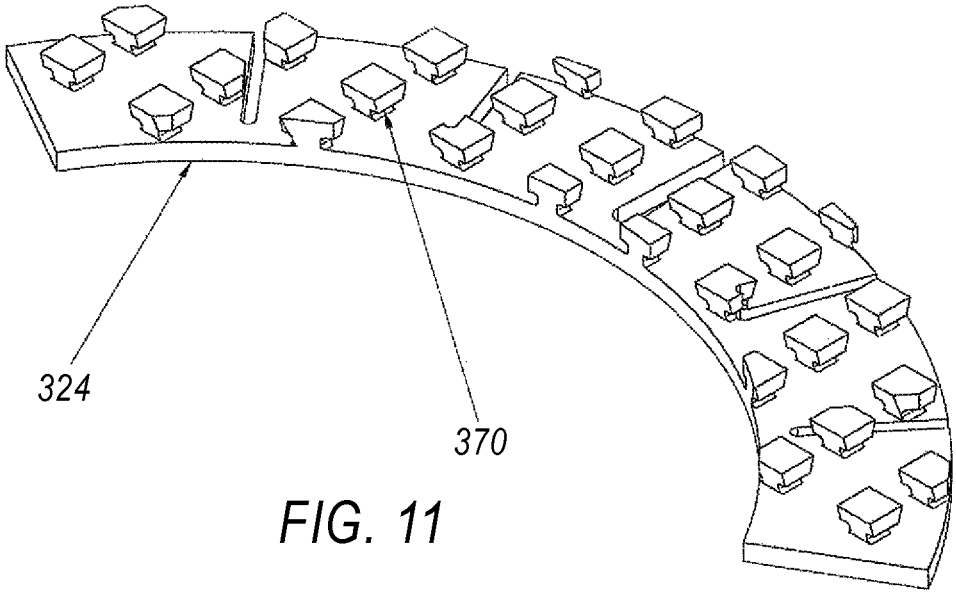
FIG. 11 is a perspective view of an alternative insert portion of the rotor of FIG. 1.
Figure 16:
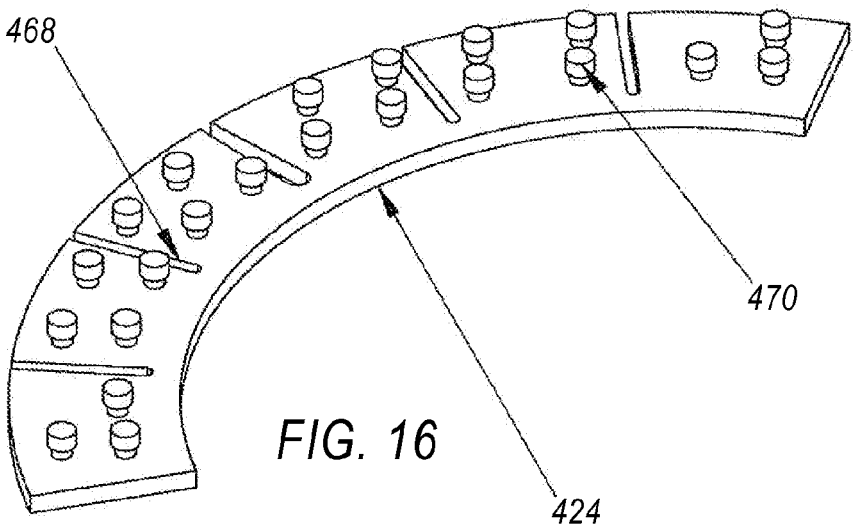
FIG. 16 is a perspective view of an alternative insert portion of the rotor of FIG. 1.

FIGS. 11 and 16 each illustrate an exemplary embodiment of a portion of a rotor 20 having a plurality of attachment portions 370 and 470 formed onto inserts 324 and 424 eliminating a secondary attachment process for coupling the attachment portions to an insert. The shape of attachment portions 370 and 470 can be any configuration for generally achieving the aforementioned objective of having dimension TA greater than the dimension TC to mechanically retain the insert to the core material 106 of the central body 22. In these exemplary embodiments, the configuration is a generally "T" shape when viewed perpendicular to the axis of the rotor. The size of each attachment portion 70, 370 and 470 should be consistent for each insert 24, 324 and 424 for balancing the rotor, although the sizes may vary if desired.

Figure 12:
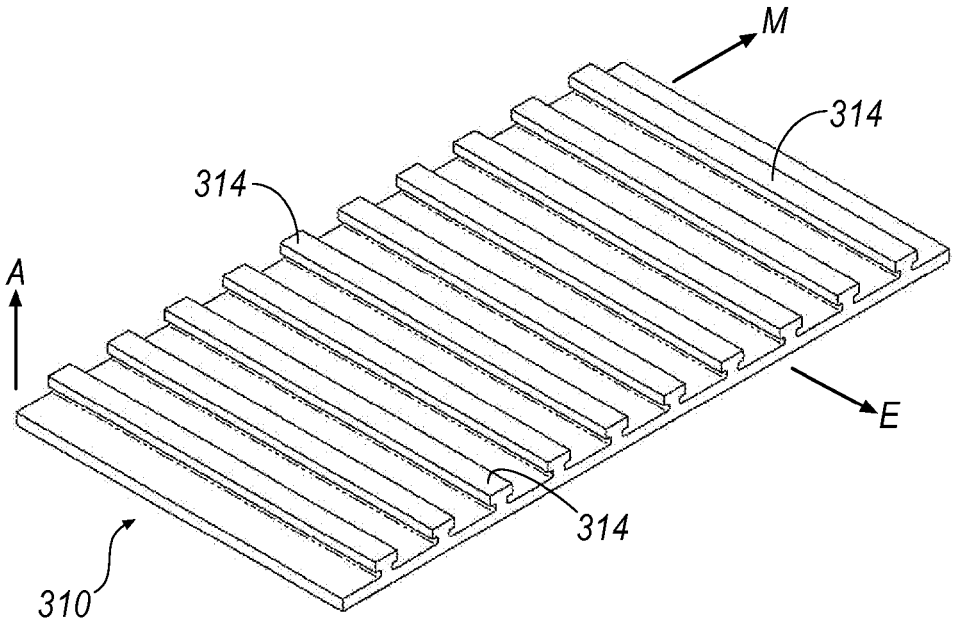
FIG. 12 is a perspective view of an intermediate article of manufacture of the alternative insert portion of FIG. 11.
Figure 13:
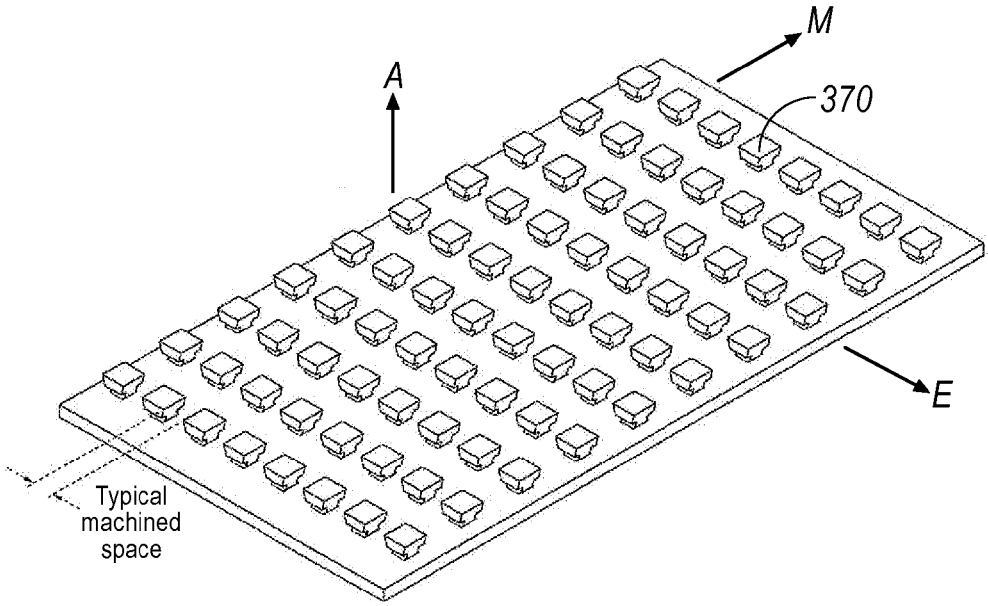
FIG. 13 is a perspective view of an intermediate article of manufacture of the alternative insert portion of FIG. 11.
Figure 14:
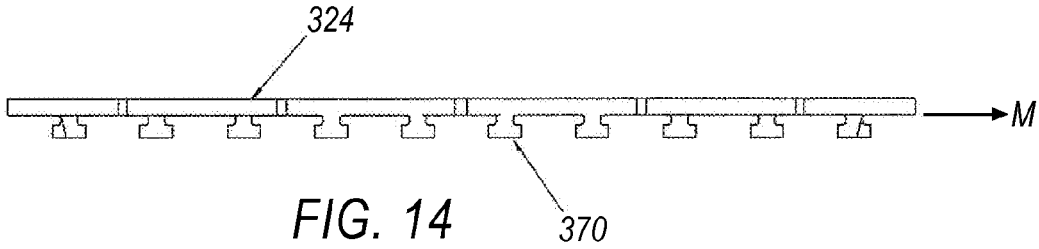
FIG. 14 is a view taken generally along line 14-14 of FIG. 15.
Figure 15:
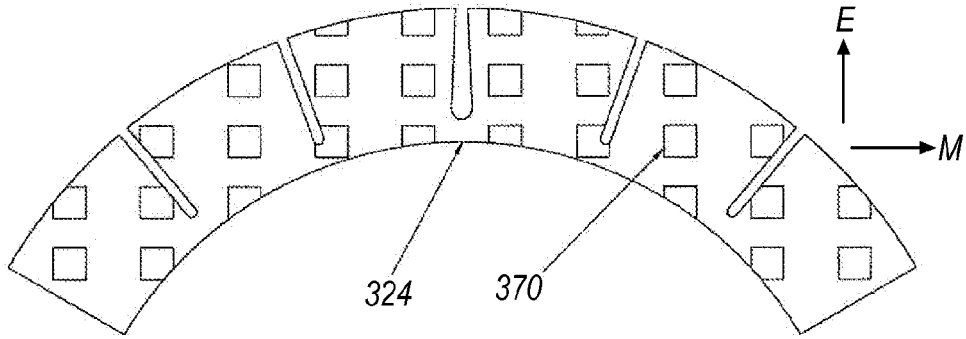
FIG. 15 is a side view of the alternative insert portion of the rotor of FIG. 11.

FIG. 11 illustrates an embodiment of a portion of the rotor 20 as a plurality of inserts 324 formed having attachment portions 370 formed thereon by removing material. Referring to FIG. 12, an insert blank 310 may be fabricated from an extruded configuration by extruding the blank 310 generally in the direction E. FIG. 12 depicts an extruded blank 310 with rows of first portions 314 formed as a "T" or any other undercutting shape capable of mechanically retaining the core material 106 during a casting process. As shown in FIG. 13, after the blank 310 is extruded, a portion of the first portions 314 is removed by milling in the direction M, which is generally perpendicular to the direction E. In the embodiment illustrated, the directions E, M, and A are generally orthogonal. The removal of material may not be in the direction M, but may be performed diagonally or radially to the direction E. FIGS. 11, 14 and 15 illustrate an embodiment of a final shape of each insert 324 cut out of extrusion 310. Various machining operations may be employed to provide desired shapes with repeatable locations of attachment portions 370. An exemplary grade of material for an extruded configuration of each insert 324 is low carbon steel, such as hot rolled ASTM A36. Higher strength grades of steel could also be extruded if desired.

Figure 17:
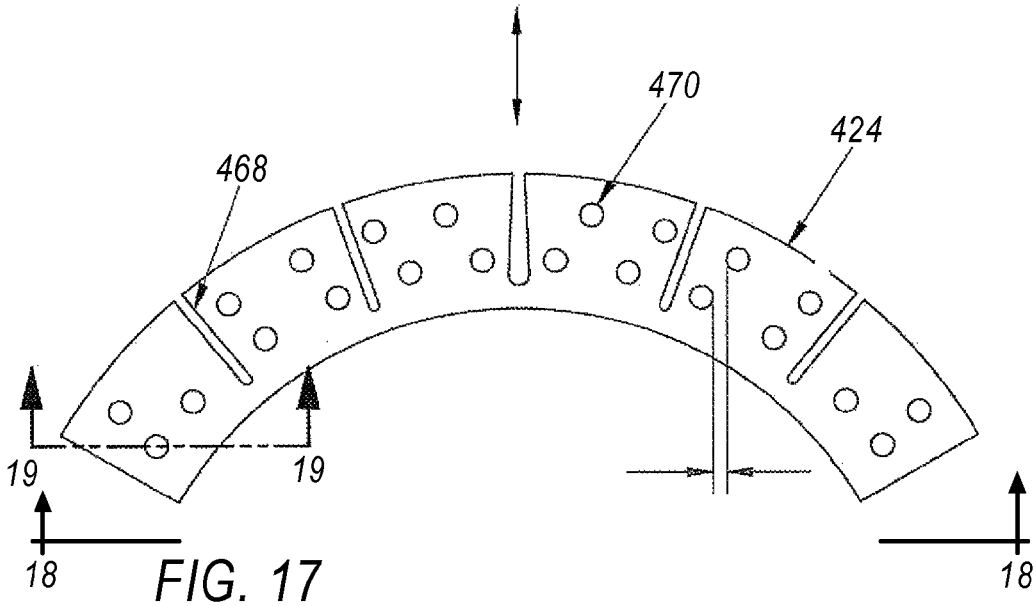
FIG. 17 is a side view of the alternative insert portion of the rotor of FIG. 1.
Figure 18:
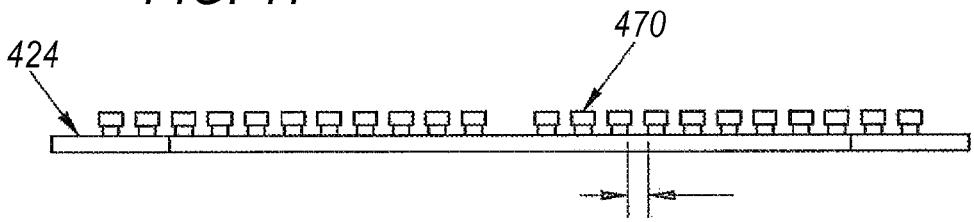
FIG. 18 is a view, taken generally along line 18-18 of FIG. 17.
Figure 19:
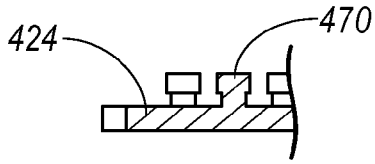
FIG. 19 is a view, taken generally along line 19-19 of FIG. 17.

FIGS. 16-19 illustrate another embodiment of the insert 24 as an insert 424. In this embodiment, attachment portions 470 are formed by molding a unitary configuration using a conventional casting process. Each attachment portions 470 is formed as a "T" or any other undercutting shape for mechanically retaining the core material 106 during a casting process. A profile view of each insert 424 showing a multiplicity of undercutting attachment portions 470 can be seen in FIG. 18. The accompanying projected view in FIG. 17 illustrates the offset of each attachment portion 470 enabling conventional side pulling tool action for casting. A cutting plane 19-19 in FIG. 17 creates the sectional view of FIG. 19 to show the unitary formation of each insert 424 and attachment portions 470. Each expansion slot 468 is formed by mold cores in a tool cavity defining the flat surfaced and generally arc shaped configuration of each insert 424. As previously mentioned, each insert must be enabled to expand and contract within core material 106 due to coefficient of expansion property differences between the two metals. It is therefore necessary to select a casting grade of iron with flexible properties. Typical gray iron castings have poor flexibility due to their matrix microstructure. Ductile iron castings such as A536-80 pearlite matrix provide a good combination of strength and wear resistance. As the name implies, this iron material has ductile properties for fatigue strength. Grades of Austempered Ductile Iron (ADI) have greater mechanical properties and wear resistance, with tensile strengths exceeding 230 ksi (1600 MPa). The use of malleable iron is also a possibility.

One skilled in the art would be aware of the wide range of properties available in selecting a specific iron material including heat treatment options to enhance performance.

Figure 22:
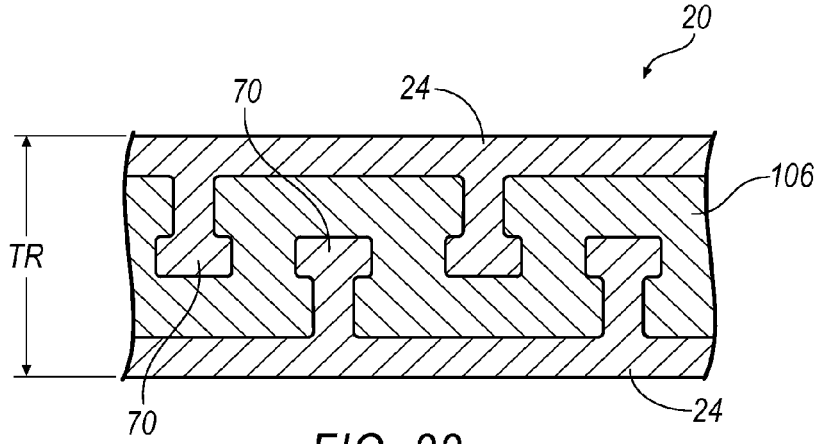
FIG. 22 is a side view of the insert portion of the rotor of FIG. 1, illustrated with offsetting attachment portions.

Advantages for the fabrication of a unitary structure of each insert 324, 424 include robustness and improved cost. The labor for attaching each attachment portions 470 is eliminated by forming the attachment portions 370, 470 and the insert 324, 424 simultaneously. The inserts 324, 424 may be more robust since they are not depending on an intermediate material for attaching. And since there is not a secondary process involving heat treatment for attaching each attachment portions 370, 470 to each insert 324, 424, concerns regarding the development of hard spots in the wear surfaces of each insert 324, 424 are eliminated. That is, if attachment portions are welded to an insert on the inner side, the opposing surface portion of the outer side may experience an undesirable change in properties, such as hardening, that may affect the performance of a rotor in operation. FIG. 22, as contrasted with FIG. 7, illustrates that the pattern of the attachment portions of opposing inserts could be configured to effect an offset of the opposing attachment portions (as opposed to the axial alignment of the attachment portions 70 of FIG. 7) to permit the rotor to be axilly thinner (dimension TR), thereby reducing mass and therefore weight if so desired in a given brake application. The offset may be accomplished by, for example, circumferentially rotating all inserts on the first brake pad wear surface 100 relative to the second brake pad wear surface 102 about the axis of the rotor, or by rearranging the attachment portions on opposing inserts to accomplish an alternating pattern, such as illustrated in FIG. 22.

Figure 10:
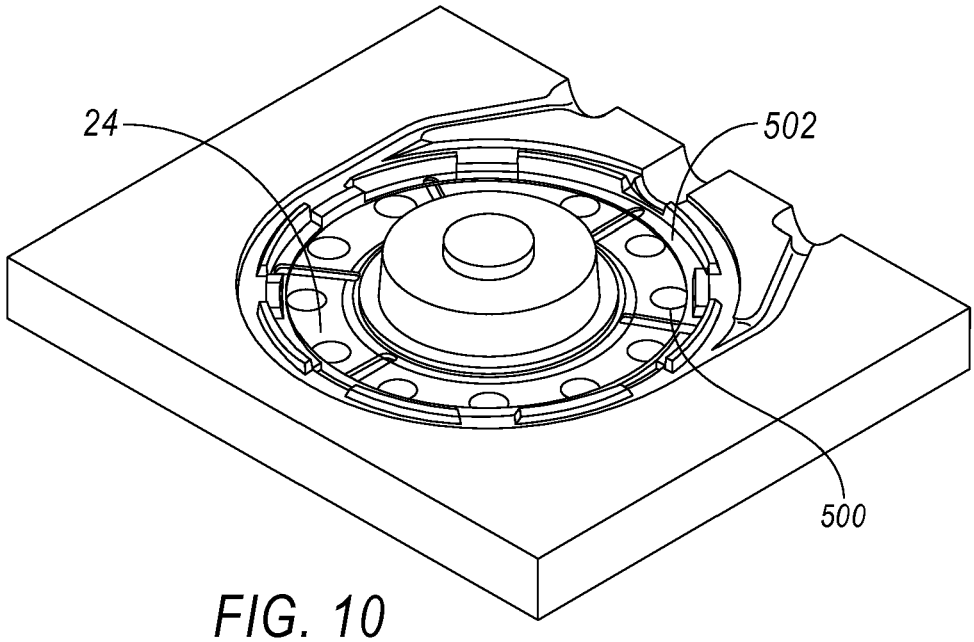
FIG. 10 is a perspective view of a portion of a mold for producing the composite rotor of FIG. 1.

Since a brake rotor is a rotating mass, placement of each attachment portion 70 requires fixturing to ensure accurate placement and symmetry for producing a balanced rotor. A fixture for introducing each of the attachment portions 70 to the inserts 24 can be configured for manual, semi-automated or fully automated positioning and attaching. Equal sizing and spacing of each insert 24 when surrounded by core material 106 is also important for meeting rotational mass balance requirements. FIG. 3 illustrates inserts 24*a*, 24*b* and 24*c* arranged to provide a balanced brake rotor assembly. Slight differences in part size and shape effecting weight may result in rotational imbalance detrimental to brake rotor performance, therefore it is important to maintain tight control of each individual each insert 24 and corresponding tooling details for equal arrangement in the casting mold. Methods for producing repeatable, equally sized components are well known to one skilled in the art. An exemplary method is by die stamping; however other processes such as laser cutting, water jet cutting, casting and the like can be used. Positioning and spacing of each insert 24 is controlled by matching features in a mold cavity. FIG. 10 shows a mold insert for an exemplary rotor configuration of three equally sized segments of each insert 24. Other embodiments could employ single or multiple segments of each insert 24 to accomplish adequate configurations for the rotor friction wear surface.

An exemplary casting process for the brake rotor is permanent mold using a tool made in two steel halves with steel cores. It would be well known to one skilled in the art that this process produces a dense casting of core material 106 with desirable mechanical properties compared to typical sand castings. The steel mold halves and core details provide chilling adequate for enhancing the required mechanical properties, quality surface finishes, uniformity of shape and relatively close dimensional tolerance for reducing costly post-machining. Permanent mold tooling also provides advantages for the high-production quantities demanded for automotive. However, casting processes such as green sand molding could also be used.

In an exemplary embodiment of a method of forming a rotor 20, three segments of each insert are placed into the mold cavity of a previously described permanent mold, arranged as shown in FIG. 10 on each half of the tool, with attachment portions directed outward from the cavity surfaces. Referring to FIG. 10, each insert is secured in place using a magnet or multiple magnets 500 arranged flush to a cavity surface 502. An exemplary embodiment would use multiple magnets 500 in a pattern conforming to the arcuate shape of each insert. The magnets 500 may of sufficient strength to hold the inserts in position throughout the casting process. The magnets 500 may also be capable of maintaining permeability properties to withstand the high temperatures of the casting process. High temperature permanent magnets made from materials such as samarium cobalt (SmCo) are suited for the application. SmCo magnets maintain their strength when subjected to temperatures up to 550° C. (1022° F.). The holding strength of the magnets 500 may also must be sufficient to penetrate multiple layers of refractory sprayed onto mold cavity surfaces 502 between cycles during the casting process. Refractory build-up may become thick enough that occasional desired removal in the magnets 500 locations in order to maintain sufficient holding strength. Other mechanical means for holding each insert in position could be used. For example, tapered pins could extend from mold cavity surface 502 for pressing into corresponding holes in each insert 24. The interference between pins and each insert 24 would be such for positively holding parts in place during the casting process without hindering removal of the finished casting from mold cavity.

Figure 20:
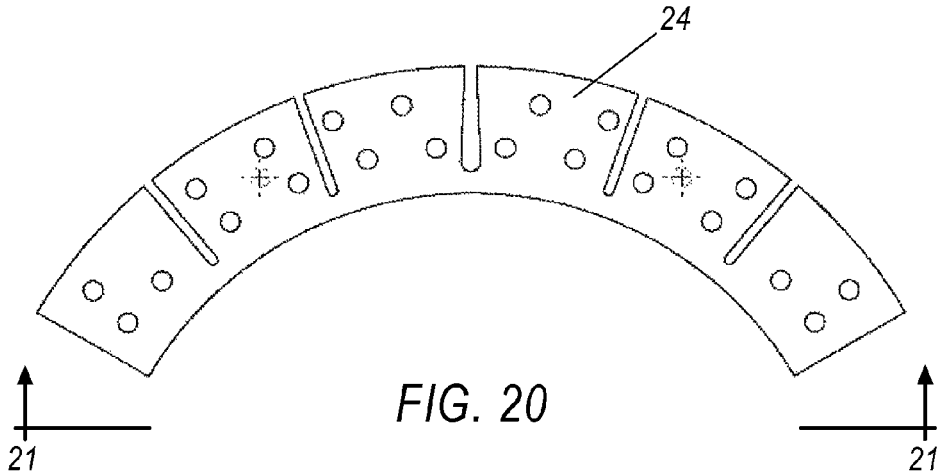
FIG. 20 is a side view of the insert portion of the rotor of FIG. 1, illustrated with a removable fastener.
Figure 21:
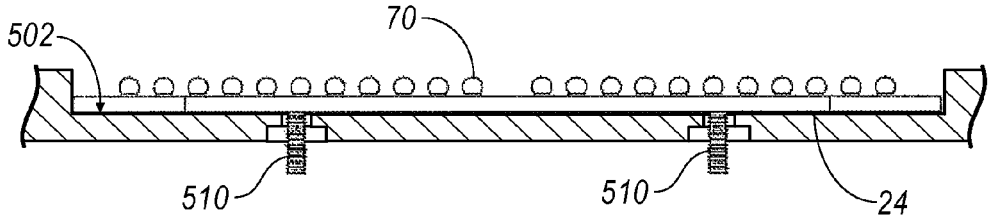
FIG. 21 is a view, taken generally along line 21-21 of FIG. 20.

FIGS. 20 and 21 illustrate an insert 24 which may be formed in any of the methods described herein, including a fastener, such as at least one screw or bolt 510 that could be affixed to or designed to pass thru each insert 24 into a mold cavity surface, such as the surface 502 and secured in place with mating nuts to hold the inserts 24 in position during casting. With the opening of the mold, the securing nuts would be removed and the cast part ejected. It would be necessary to remove each holding screw or bolt 510 flush to or below the exposed functional wear surface of each insert 24 during subsequent finish machining operations. Such a process would likely be labor intensive and cumbersome when compared to the exemplary magnet holding method described herein. Another holding method could be to use an adhesive applied to the outer surface 62 of each insert 24 to be in contact with mold cavity surface 502. For example, a double-backed very high bond type adhesive with a peel-off release liner could be used. Such an application would require the materials involved to be capable of withstanding the high temperatures of mold cavity contact surface 502 from continuous processing. The strength of the adhesive would be configured for positively holding parts in place during the casting process without hindering removal of the finished casting from mold cavity.

FIGS. 1-7 depict the resulting composite casting of a typical flanged circular body rotor 20 configuration comprised of core material 106 mechanically bonded to each insert 24 by means of each attachment portions 70 on opposing sides of the flanged portions, with generally smooth outer surfaces of insert 24 exposed for contact mating brake friction components. Secondary machining removes excess material from each insert 24 and core material 106 casting to specific requirements for surface finish, fitting to mating geometry, and to add a plurality of lug connecting apertures 52. A coating can be added to the surfaces of each insert 24 and core material 106 to prevent corrosion and oxidation build-up. Such coatings are typical to brake rotor applications and are well known to one skilled in the art.

In an exemplary embodiment, each insert 24 is not plated, coated or otherwise secondarily treated to provide corrosion resistance. It is well known to one skilled in the art that a brake rotor is exposed to weathering elements and is therefore susceptible to corrosion. The aluminum alloy surfaces of core material 106 will slowly corrode over time as a result of the formation of aluminum oxide; however the material beneath the oxide coating is sufficiently protected by means of the passivation process. Each exposed insert 24 will form iron oxides, more commonly known as rust. In a brake rotor application any corrosion build-up, on either aluminum or steel surfaces is continually wiped clean by contact with brake pads during normal operation.

In an exemplary embodiment the aluminum structure of core material 106 formed under and around each attachment portion 70 provides a sufficient primary means for joining each insert 24 to core material 106. In another embodiment, metallurgical bonding between dissimilar metals could provide a source of additional structural connectivity between each insert 24 and core material 106. In this embodiment, the bonding of each insert 24 to core material 106 is accomplished by both metallurgical and mechanical interlocking. For example, inserts 24, including each attachment portion 70, could be galvanized to create a zinc (coating 90 as shown in FIG. 7A) and steel metallurgical or molecular bond at the interface with core material 106. During the casting process, the molten aluminum that comprises core material 106 reacts with the zinc galvanized surface on each insert 24 to form a zinc and aluminum alloy. This three material gradient bond structure (steel, zinc and aluminum), which occurs at the atomic level may be produced when the lattice structures of the dissimilar metals are forced into conformance with each other at the interface surfaces. The properties of the galvanized zinc coating may be more capable of improving the metallurgical bond with the aluminum alloy in comparison to bonding the aluminum with uncoated steel. The galvanized coating of zinc provides the additional benefit of corrosion protection of each insert 24 in this embodiment, and because the interface of the metals is a molecularly bonded alloy, there is no corrosion causing moisture path between metals.

In another embodiment, each insert 24 may be selectively plated on the surface 60 to be in contact with core material 106. The plating may include copper which may react to form a metallurgical bond with the aluminum during the casting process, resulting to create a copper and aluminum alloy. This is another three material gradient bond structure (steel, copper and aluminum) for combined metallurgical and mechanical interlocking. As with the galvanized embodiment, the copper and aluminum alloy at the interface surface may also be beneficial for preventing a corrosion causing moisture path between metals in this embodiment. The unplated surfaces of each insert 24 may be kept from corroding by means of continual wiping of the brake pads during normal operation. The method of selectively plating only the surfaces of each insert 24 could be applied during a heat treatment process for joining a multiplicity of attachment portions 70 to each insert 24, or by any other plating or coating process well known in the art. Since less material is used in coating only one side of each insert 24, there may be a cost advantage for selectively plating. It may be advantageous for some clad metal applications to coat or plate the entire each insert 24, however in a brake rotor application it is preferred to keep the brake pad wearing surfaces free of plating since other materials may compromise optimum braking performance. While any thinly applied plated materials will quickly be worn away during normal braking, soft metals such as copper and zinc may gall unevenly as it is rubbed away and may damage the contacting brake pads.

In yet another embodiment, each insert 24 could be selectively plated with stainless steel on the surface 60 to be in contact with core material 106. Unlike the embodiments described using zinc and copper as a coating for the surface or surfaces of each insert 24, stainless steel plating may not react with the aluminum during the casting process to form a metallurgical bond. This embodiment relies strictly on mechanical interlocking. Because these materials are not alloyed, a moisture path exists between the metals that may cause corrosion. However, stainless steel has properties that resist corrosion, therefore the interface surfaces are kept from forming iron oxide. Once again, the unplated surfaces of each insert 24 are continually wiped clean by the brake pads during normal operation preventing corrosion.

It is also possible to use a pre-thermal treatment of each insert 24 to improve casting adhesion between the segments and core material 106. However, such thermal treatment is not used in some of the exemplary embodiments as sufficient adhesion has proven to be attainable without thermal treatment. These thermal treatments may add undesirable cost and increase difficulty in part handling.

Since aluminum has thermally conductive properties superior to that of typical cast iron, it may be possible to reduce the thickness of a brake rotor produced by the methods described above, providing additional weight savings when compared to an equivalent cast iron rotor. Weight reduction of brake rotors contributes to several important benefits such as reducing unsprung mass for improved ride and handling, increased braking stability and effectiveness, reduced fuel consumption and its companion objective to reduce $CO_2$ emissions for addressing greenhouse effect concerns, reduced tire wear, and the like.

In addition to providing weight reduction, the core material 106 also provides a means for heat dissipation in a brake rotor application. Automotive brake rotors must conform to testing defined in Federal Motor Vehicle Safety Standards FMVSS-135. Frictional heat build up on rotor surfaces can cause brake "fade" which results in reduced performance. Aluminum alloys are well known for an ability to rapidly draw heat away from adjacent components in contact. In a brake rotor application, friction heat built up from brake pad contact is transferred from each insert 24 surface to core material 106 and dissipated to atmosphere.

In an exemplary embodiment, the thermal transfer properties of core material 106 aluminum alloy A356.2 is 92 Btu·ft/hr·ft$^2$·F, compared to far lower thermal properties of 25-30 Btu·ft/hr·ft$^2$·F for the typical grey cast iron brake rotor. Comparison testing of aluminum versus cast iron brake rotors shows improved braking effectiveness as wear surfaces remain cooler on the aluminum rotor. Minimizing frictional heat build up also considerably extends the life of brake pads and wearing surfaces of a brake rotor.

If an application requires additional or faster heat transfer, cored vents could be added to the rotor 20 to decrease the mass of core material 106, thereby allowing air to affect the cooling time. Such practice is well known to one skilled in the art. Such material coring would also further reduce the weight of a brake rotor 20.

The methods for providing a clad composite component disclosed herein are not limited to a brake rotor application. It would be possible to apply these methods to other applications requiring lightweight weight construction with secondary surfaces featuring properties or characteristics enabling impact resistance, wear resistance, a specific appearance or texture, or the like.

Although the steps of the method of making the rotor 20 are listed in a preferred order, the steps may be performed in differing orders or combined such that one operation may perform multiple steps. Furthermore, a step or steps may be initiated before another step or steps are completed, or a step or steps may be initiated and completed after initiation and before completion of (during the performance of) other steps.

The preceding description has been presented only to illustrate and describe exemplary embodiments of the methods and systems of the present invention. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope. The scope of the invention is limited solely by the following claims.

What is claimed is:

1. A method of forming a brake rotor comprising:

forming a plurality of annular metal insert portions, each insert portion having an inner side and an outer side;

forming a plurality of attachment members coupled to and extending outwardly from the inner side;

forming a plurality of slots in the insert portions, the slots having a depth coextensive with a thickness of the insert portions, the slots extending radially inwardly from an outer circumference of the annular insert portions; the slots being spaced apart about the circumference such that a plurality of attachment members are positioned between each pair of adjacent slots;

positioning the plurality of insert portions into a mold using a magnetic attractive force to retain the insert portions within the mold such that the inner side of one of the plurality of insert portions faces the inner side of another one of the insert portions;

introducing a molten aluminum into the mold such that the molten aluminum contacts the inner side of each insert portion; and forming a mechanical coupling between the aluminum and at least a portion of at least one of the inserts.

2. The method of claim 1, further comprising forming a metallurgical bond between the aluminum and a metal coating on at least a portion of the inner side of each insert portion.

3. The method of claim 1, further comprising galvanizing at least a portion of the inner side of at least a portion of the insert portion.

4. The method of claim 1, further comprising heat treating at least a portion of one of the plurality of insert portions.

5. A method of forming a brake rotor comprising:

forming a plurality of metal insert portions, each insert portion having an inner side and an outer side;

forming a plurality of spaced apart slots in the plurality of insert portions to reduce distortion, each slot extending through an outer perimeter of the insert portion and each slot having a longitudinal axis extending radially inwardly;

forming a plurality of protruded attachment members between each adjacent pair of slots on the inner side of the insert portions;

positioning the plurality of insert portions into a mold using a magnetic attractive force to retain the insert portions within the mold such that the inner side and protruded attachment portions of a first insert portion faces the inner side and protruded attachment portions of a second insert portion;

introducing a molten aluminum into the mold such that the molten aluminum contacts the inner side of each insert portion; and forming a mechanical coupling between the aluminum and at least a portion of at least one of the insert portions.

6. The method of claim 5, further comprising coupling a metal coating on at least a portion of the inner side of each insert portion.

7. The method of claim 6, further comprising forming a metallurgical bond between the aluminum and the metal coating.

8. The method of claim 5, wherein the insert portions are constructed of a steel and at least a portion of the attachment portions of the first insert portion are in axial alignment with at least a portion of the attachment portions of the second insert portion.

9. The method of claim 5, wherein at least a portion of the attachment portions include an undercut portion for promoting the mechanical coupling.

10. The method of claim 5, wherein forming at least a portion of the plurality of attachment members includes removing material from a first portion of at least one of the inserts.

11. The method of claim 5, wherein using the magnetic attractive force comprises using an arcuately distributed magnets to retain the insert portions in the mold.

* * * * *